United States Patent [19]

Rothwell, Jr. et al.

[11] Patent Number: 4,884,009

[45] Date of Patent: Nov. 28, 1989

[54] COLOR SELECTABLE SOURCE FOR PULSED ARC DISCHARGE LAMPS

[75] Inventors: Harold L. Rothwell, Jr., Georgetown, Mass.; Jeffrey O. Grant, Indianapolis, Ind.

[73] Assignee: GTE Products Corporation, Danvers, Mass.

[21] Appl. No.: 135,192

[22] Filed: Dec. 18, 1987

[51] Int. Cl.[4] ..... H05B 41/30; H01J 7/24; H01J 61/12

[52] U.S. Cl. ..... 315/246; 315/115; 313/15; 313/568; 313/637

[58] Field of Search ..... 315/246, 108, 109, 110, 315/112, 113, 114, 115, 116, 117, 118; 313/15, 572, 573, 574, 575, 576, 637, 638, 639, 640, 641, 642, 643, 568, 577

[56] References Cited

U.S. PATENT DOCUMENTS

| | | | |
|---|---|---|---|
| 3,914,649 | 10/1975 | Hug | 315/241 R |
| 4,101,807 | 7/1978 | Hill | 315/117 X |
| 4,137,484 | 1/1979 | Osteen | 315/107 X |
| 4,734,612 | 3/1988 | Sasaki et al. | 313/15 |

*Primary Examiner*—David Mis

*Attorney, Agent, or Firm*—Joseph S. Romanow

[57] ABSTRACT

The present invention is directed to a novel system for producing selectable color bands from a single emission source. More particularly, this invention is directed to a small emission source consisting of a gas discharge means. The emission source in the present invention is preferably a single-ended fused silica capsule which encloses one or more predetermined metal halide salts and an inert gas, preferably argon gas.

21 Claims, 2 Drawing Sheets

COLOR SELECTABLE SOURCE FOR PULSED ARC DISCHARGE LAMPS

BACKGROUND OF THE INVENTION

The present invention is directed to a novel system for producing selectable color bands from a single emission source in a pulsed arc discharge lamp. More particularly, this invention is directed to a small emission source for a pulsed arc discharge lamp, consisting of a gas discharge means and a method of activating this discharge means.

The applications for a multi-color pulsed arc discharge system are very widespread, ranging from signal and warning lighting to color projection of graphic information. The ability to select any of several narrow color bands from a single source greatly enhances the multi-color options that can be employed in signal and projection applications.

Conventional (i.e.. non-pulsed) metal halide arc lamps typically comprise a fused silica tube with two electrodes, a rare gas for starting, a charge of mercury, and one or more metal halides, generally iodides. In operation, a starting voltage of about 300V is applied across the electrode gap causing the contents of the arc tube to vaporize, resulting in a high temperature, high pressure, wall stabilized arc in a gas, consisting principally of mercury vapor, ionized metal atoms and iodine molecules. The output spectrum (i.e., the color of the discharge) consists predominantly of the spectrum of the added metals. Color output for such lamps is tailored by varying the metal halides added to the arc tube. See for example, Waymouth, "Electric Discharge Lamps," Chapter 8, MIT Press, (1971).

In the case of pulsed arc discharge lamps, the prevailing wisdom generated through years of experience with conventional metal halide arc discharge lamps fails to provide even a hint as to what color can or will be obtained based upon a given selected metal-halide. The pulsed arc discharge lamp operates at a much lower temperature than the conventional metal halide discharge lamp, and thus, all of the conventional theories regarding color generation are useless as predictors of success.

Low pressure sodium lamps have previously been suggested as light sources in photocopying applications, see for example Hug, U.S. Pat. No. 3,914,649. An example of pulsed high pressure sodium vapor lamps is found in Osteen, U.S. Pat. No. 4,137,484.

SUMMARY OF THE INVENTION

The present invention is directed to a novel system for producing selectable color bands from a single emission source in a pulsed arc discharge lamp. More particularly, this invention is directed to a small emission source for a pulsed arc discharge lamp, comprising a gas discharge means and a method of activating this discharge means.

The emission source in the present invention is preferably a single-ended fused silica capsule which encloses one or more predetermined metal halide salts and an inert gas, preferably argon gas.

It has been discovered that for pulsed metal halide discharge lamps of the type described herein, the color of the emission is directly related to the duration of the current pulse. Both short pulses (e.g. about 5 microseconds and below, preferably about 1 microsecond) and long pulses (e.g. greater than about 5 microseconds, preferably about 10 microseconds) were analyzed for their effect upon the emission color.

The present invention is also directed to a method and testing apparatus for determining the effect of pulse duration on metal halide salts for variation in emission color.

DETAILED DESCRIPTION OF THE PREFERRED EMBODIMENTS

Figure 1:
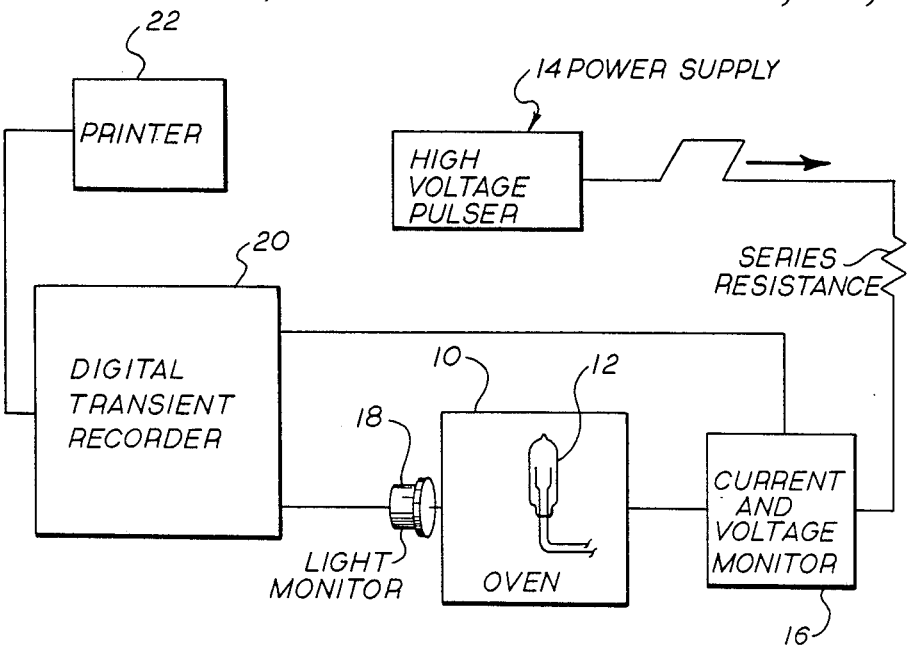
FIG. 1 represents in schematic form, the testing apparaus of the present invention.

The present invention is directed to a novel system for producing selectable color bands from a single emission source in a pulsed arc discharge lamp. One preferred capsule and source excitation testing scheme is illustrated in FIG. 1.

An oven 10 is used to heat the arc tube 12 and its contents, thereby adjusting the vapor pressure of the metal halide disposed therein to an optimum level for the production of a fairly diffuse, well-behaved discharge during excitation.

The vapor pressure in the arc tube is generally maintained within the range from about 0.3 to 10 Torr. Once the requisite vapor pressure has been achieved by heating the arc tube, the power supply 14 generates a high voltage (0.5–2.0 Kv) pulse which causes a high current discharge to form across the electrode gap of the arc tube.

Current and voltage are monitored during the testing by monitor 16 and light output is correspondingly analyzed and recorded for all different voltage and/or current levels by a light monitor 18 and a digital transient recorder 20. A printer 22 provides hard copy results of all test data generated.

The current was limited to approximately 1.8 amperes for the duration of each pulse, and the duration of the pulse was found to establish the dominant color of the emission.

For the preferred metal halide salts employed herein, the duration ranged from about 1 to 10 microseconds. For other metal halide salts and mixtures of such salts, longer or shorter duration pulses may be employed to vary the color output according to the teachings of this specification.

During short pulses, e.g. from about 1 to 5 microseconds, the emission appears to be produced by a fairly diffuse glow. For long pulses, e.g. from about 5 to 10 microseconds, a glow-to-arc transition occurs.

Table I illustrates the dominant colors, approximate capsule temperatures, metal halide vapor pressures, and number densities for the two most preferred metal halides used in conjunction with the present invention, namely, cadmium and zinc iodide.

TABLE I

| | Cadium Iodide | Zinc Iodide |
|---|---|---|
| Glow | Red | Peach |
| Arc | Bluish Green | Blue |
| Temperature | 380° C. | 360° C. |
| Pressure | 0.3 Torr | 0.4 Torr |

TABLE I-continued

| | Cadium Iodide | Zinc Iodide |
|---|---|---|
| Number Density | $4.4 \times 10^{18}$/ml | $6.1 \times 10^{18}$/ml |

Figure 2A:
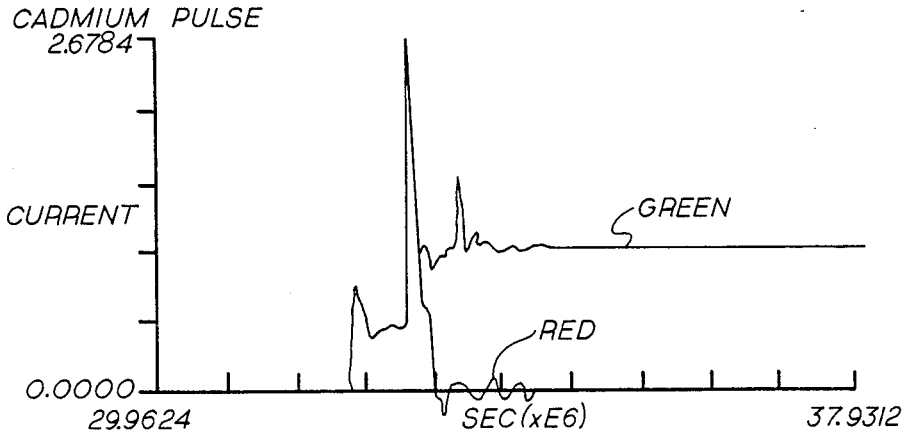
FIGS. 2A, 2B and 2C illustrate electrical/optical plots of color output for pulsed arc discharge lamps prepared according to the present invention.
Figure 2B:
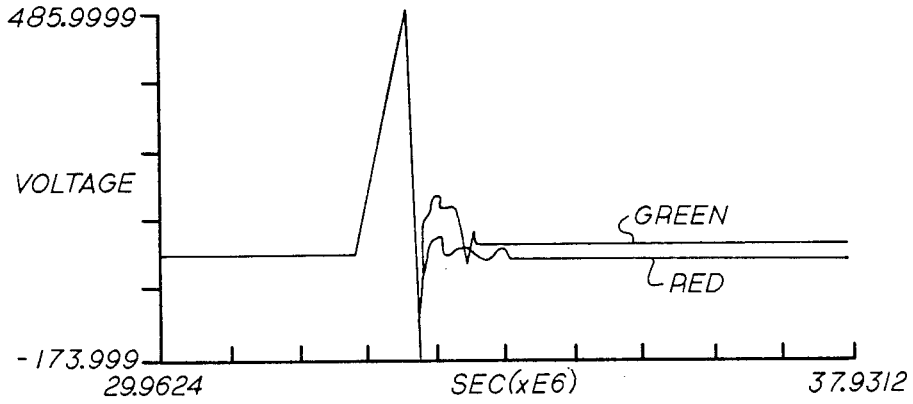
Figure 2C:
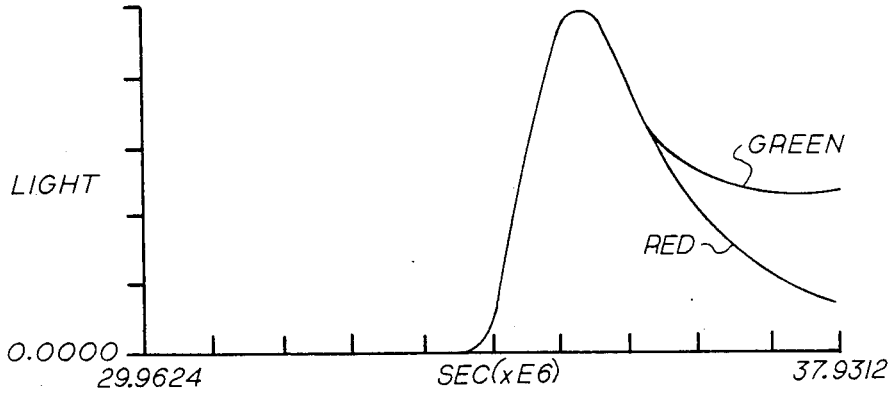

FIGS. 2 (A), (B) and (C) illustrate in the case of cadmium some of the electrical and optical differences between short and long pulse lengths of (i.e., 1 v. 10 microseconds). FIG. 2A illustrates current v. time; FIG. 2B illustrates voltage v. time; and FIG. 2C illustrates light (color) output v. time.

The time scale of FIGS. 2A 2B, and 2C is in microseconds, and thus, the long pulse extends beyond the end of the plot. As illustrated, with a 1 microsecond pulse, a reddish light is given off. Green light is the dominant color for pulse widths beyond 1 microsecond.

It will be noted that the green light intensity is roughly twice that of the red, although both light curves have been scaled to be the same size for shape comparison. Notice that the red light fades exponentially from its peak, while the green light levels out to a non-zero value for the duration of the longer pulse.

The transition between red and green appears to occur at the point in time where the initially high voltage collapses and the current increases, i.e. the glow-to-arc transition. The dominant red color appears to be associated with the higher electron energy of the glow state, while green is associated with the lower average electron energy of the arc state.

While not wishing to be bound by theory, this interpretation of the color transition is consistent with the Grotrian diagram of available energy states of cadmium. The initial excitation channel involves singlet excitation with the strongest transition being the 3D-2P (6438A). For longer pulse widths the increase in collisional interaction allows the triplet states to be populated. Associated observed transitions are $2S\text{-}2P_1$ (5086A), $2S\text{-}2P_2$ (4800A), and $2S\text{-}2P_3$ (4578A). Presumably a large fraction of the triplet states are populated by recombination of highly excited or ionized cadmium.

Zinc exhibits characteristics similar to cadmium. The color transition for zinc is from a peach color to blue. The dominant observed wavelengths are 6362 Angstroms (singlet state) and 4811, 4722 and 4680 Angstroms (triplet states).

Mercury, another member of Group IIB of the Standard Periodic Table of the Elements, is expected to exhibit similar emissions. Similarly, other metal halides can readily be analyzed using the testing apparatus and methodology discussed in connection with FIG. 1.

This invention is also directed to a small emission source for a pulsed arc discharge lamp, consisting of a gas discharge means and a method of activating this discharge means.

Figure 3:
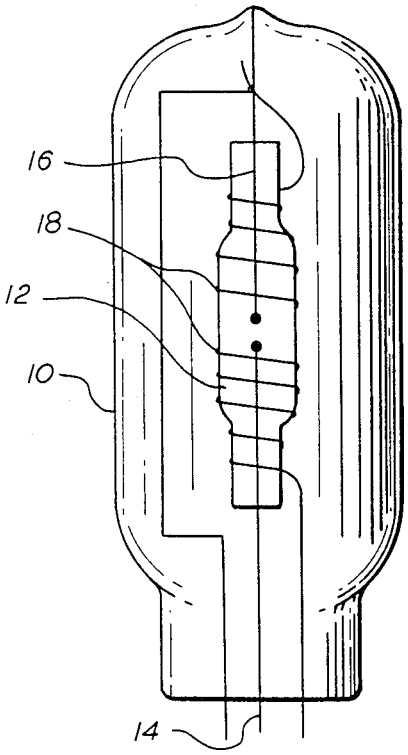
FIG. 3 illustrates one self-contained lamp design incorporating the principles of the present invention.

A practical lamp design incorporating both the new gas discharge means and the activation method is illustrated in FIG. 3.

The lamp comprises a clear glass vacuum outer jacket 10, a light transparent fused silica arc tube 12, which contains the selected metal halide salt and argon gas. Two electrodes 14 and 16 extend into the arc tube 12 from opposing ends thereof. At least partially surrounding the arc tube 12 is a heating coil 18 which is used to achieve the necessary vapor pressure of the contents of the arc tube prior to the addition of the voltage pulse. As set forth above, depending upon the selected metal halide fill and the current pulse duration, one may select a desired color output for lamps of this type.

Lamps such as those illustrated in FIG. 3 provide a compact source which can be used, for example, as a signal flasher. Alternatively, lamps having double-ended geometry could be designed which would lend itself to axial focusing optics that can be used in projection systems.

The present invention has been described in detail, including the preferred embodiments thereof. However, it will be appreciated that those skilled in the art, upon consideration of the present disclosure, may make modifications and improvements on this invention and still be within the scope and spirit of this invention as set forth in the following claims.

What is claimed is:

1. A method of producing light substantially within a particular color band from an emission light source in a pulsed metal halide arc lamp comprising the steps of:

(a) selecting a desired band of colored light;

(b) adjusting the vapor pressure of the metal halide salt in the lamp to within the range of from about 0.3 to 10 Torr; and (c) applying a high voltage current pulse of from about 0.5 to 2.0 Kv to said lamp, for a sufficient period of time to generate the desired color.

2. The method of claim 1, wherein the vapor pressure of the metal halide lamp is adjusted by heating the arc tube.

3. The method of claim 2, wherein the predetermined color is red.

4. The method of claim 3, wherein the metal halide salt is cadmium iodide.

5. The method of claim 4, wherein the temperature of the arc tube prior to the addition of the current pulse is 380° C.

6. The method of claim 5, wherein the vapor pressure of the cadmium iodide is about 0.3 Torr.

7. The method of claim 2, wherein the predetermined color is bluish-green.

8. The method of claim 7, wherein the metal halide salt is cadmium iodide.

9. The method of claim 8, wherein the temperature of the arc tube prior to the addition of the current pulse is 380° C.

10. The method of claim 9, wherein the vapor pressure of the cadmium iodide is about 0.3 Torr.

11. The method of claim 2, wherein the predtermined color is peach.

12. The method of claim 11, wherein the metal halide salt is zinc iodide.

13. The method of claim 12, wherein the temperature of the arc tube prior to the addition of the current pulse is 360° C.

14. The method of claim 13, wherein the vapor pressure of the zinc iodide is about 0.4 Torr.

15. The method of claim 2, wherein the predetermined color is blue.

16. The method of claim 15, wherein the metal halide salt is zinc iodide.

17. The method of claim 16, wherein the temperature of the arc tube prior to the addition of the current pulse is 360° C.

18. The method of claim 17, wherein the vapor pressure of the zinc iodide is about 0.4 Torr.

19. A pulsed metal halide arc lamp producing light substantially within a particular color band, said lamp comprising:

(a) a light-transmissive outer jacket;

(b) an arc tube disposed within said outer jacket;

(c) two electrodes protruding into said arc tube such that there is a gap between the internal terminations of said electrodes;

(d) an emissive material within said arc tube including a metal halide salt and an inert gas, said metal halide salt having the property that it will produce light substantially within said particular color band when said arc tube is heated to a predetermined temperature range and an electrical pulse of a predetermined length is applied across said electrodes;

(e) means for heating said arc tube to approximately said predetermined temperature range; and (f) means for applying an electrical pulse across said electrodes, said pulse having a length of approximately said predetermined pulse length.

20. A pulsed metal halide arc lamp as described in claim 19 wherein said metal halide salt is selected from the group consisting of cadmium iodide, zinc iodide, and mercury iodide.

21. A pulsed metal halide arc lamp as described in claim 20 wherein said means for heating said arc tube includes a heater coil partially surrounding said arc tube.

* * * * *